US007837503B2

(12) United States Patent
Hartzell et al.

(10) Patent No.: US 7,837,503 B2
(45) Date of Patent: Nov. 23, 2010

(54) METHOD AND APPARATUS TO PROVIDE ELECTROMAGNETIC INTERFERENCE SHIELDING OF OPTICAL-ELECTRICAL MODULE

(75) Inventors: Robert Hartzell, Emerald Hills, CA (US); Zining Huang, Cupertino, CA (US); Frank David Yashar, Cupertino, CA (US); Henri Li, Fremont, CA (US)

(73) Assignee: Opnext, Inc., Eatontown, NJ (US)

( * ) Notice: Subject to any disclaimer, the term of this patent is extended or adjusted under 35 U.S.C. 154(b) by 20 days.

(21) Appl. No.: 12/056,557

(22) Filed: Mar. 27, 2008

(65) Prior Publication Data

US 2009/0247010 A1 Oct. 1, 2009

(51) Int. Cl.
*H01R 13/62* (2006.01)

(52) U.S. Cl. ..... 439/607.02; 439/607.21; 439/607.28

(58) Field of Classification Search ..... 439/607.2, 439/607.21, 607.28, 607.02
See application file for complete search history.

(56) References Cited

U.S. PATENT DOCUMENTS 6,362,910 B1 3/2002 Tokita
6,524,134 B2 * 2/2003 Flickinger et al. ..... 439/607.2
6,540,555 B1 * 4/2003 Festag et al. ..... 439/607.2
6,705,879 B2 * 3/2004 Engel et al. ..... 439/76.1
6,780,053 B1 * 8/2004 Yunker et al. ..... 439/607.2
6,824,429 B2 * 11/2004 Hwang ..... 439/607.2
6,881,095 B2 * 4/2005 Murr et al. ..... 439/607.2
6,922,231 B1 7/2005 Wang et al.
6,935,882 B2 * 8/2005 Hanley et al. ..... 439/372
7,186,134 B2 3/2007 Togami et al.
7,314,384 B2 1/2008 Togami et al.
7,357,673 B2 * 4/2008 Long ..... 439/607.2
7,597,590 B2 * 10/2009 McColloch ..... 439/607.18
2002/0072274 A1 * 6/2002 Flickinger et al. ..... 439/607
2006/0252311 A1 * 11/2006 Togami et al. ..... 439/607

* cited by examiner

*Primary Examiner*—Gary F. Paumen
(74) *Attorney, Agent, or Firm*—Kaplan Gilman & Pergament LLP

(57) ABSTRACT

A pluggable optical/electrical module is disclosed. One or more features operate to decrease electromagnetic interference are implemented, which features include deforming the portions that mate together to form the housing, placing elbow deformities on extending fingers to more properly seal the housing convex shape to housing to seal gaps between multiple sections, and placing an EMI insulating material within an opening that is formed for the latch that locks the module in place in a chassis.

7 Claims, 8 Drawing Sheets

METHOD AND APPARATUS TO PROVIDE ELECTROMAGNETIC INTERFERENCE SHIELDING OF OPTICAL-ELECTRICAL MODULE

TECHNICAL FIELD

The present invention relates to electromagnetic interference (EMI) shielding, and more particularly, to an improved method and apparatus for shielding electronic modules from EMI entering or exiting. The invention has particular applicability in small form factor pluggable (SFP and SFP+) optical transceivers, small pluggable modules that are typically installed in a shelf or chassis and used in optical communications systems.

BACKGROUND OF THE INVENTION

Small form factor pluggable optical transceivers ("SFPs") are known in the art. Typically, such transceivers consist of an elongated module with at least optical two ports, one for receiving light pulses and another for transmitting light pulses to a remote location. Such devices also typically include an electrical interface. Examples of such devices are disclosed in U.S. Pat. Nos. 7,314,384, and 7,186,134.

These SFP modules typically plug into a shelf or chassis to be used in an optical switch or router. Such modules often include fingerstock that extend outwardly and upwardly from the device in a manner that leaves the end of the fingers not in contact with the SFP. The ends of the fingers resiliently press the rack or chassis and serve to connect the outside of the SFP module to the chassis. One such finger is shown in FIG. 1, which depicts the open end 101 of a finger for resiliently pressing against a chassis, and a length 102 of the finger that extends along the outside surface of the SFP module. The length 102 of the finger is shown extremely magnified.

One problem is that the point of contact between each finger and the SFP housing is somewhat undefined. Among numerous fingers for a particular SFP module, there may be different contact points. This is due largely to imperfections in the outside surface of the SFP module and the bottom surfaces of the fingers, as depicted in FIG. 1. The point of actual contact between each finger and the surface of the SFP module is thus less than exact.

The distance between the end of the finger that resiliently presses against the chassis, to the part of the finger that contacts the outer surface of the SFP module, represents a source of EMI leakage. Because of the variability of this distance among the plural fingers for a particular SFP module, in some cases, this distance may be longer than the wavelength of signal which represents the EMI (Electromagnetic Interference). This means the gap under the finger permits EMI interference to pass. This problem is particularly acute in relatively high frequency systems, wherein the wavelengths of interest are relatively short.

Another problem with prior art arrangements such as that shown in FIG. 1 is that the modules are typically built from the upper and lower housing, shown as 112 and 114 in FIG. 1. Because the seal 113 is never exactly perfect, gaps are left which also provide for EMI leakage.

A still further problem relates to the latch used to maintain the SFP module in the chassis in which it is typically installed. More specifically, there is often a slidable latch or similar type mechanism that clips the SFP into the chassis. However, this movable part also presents a source of EMI leakage because the EMI signals may leak in around the slidable part.

In view of the foregoing, there exists a need in the art for a more effectively sealed module in order to prevent EMI leakage.

DETAILED DESCRIPTION OF THE PREFERRED EMBODIMENT

Figure 2:
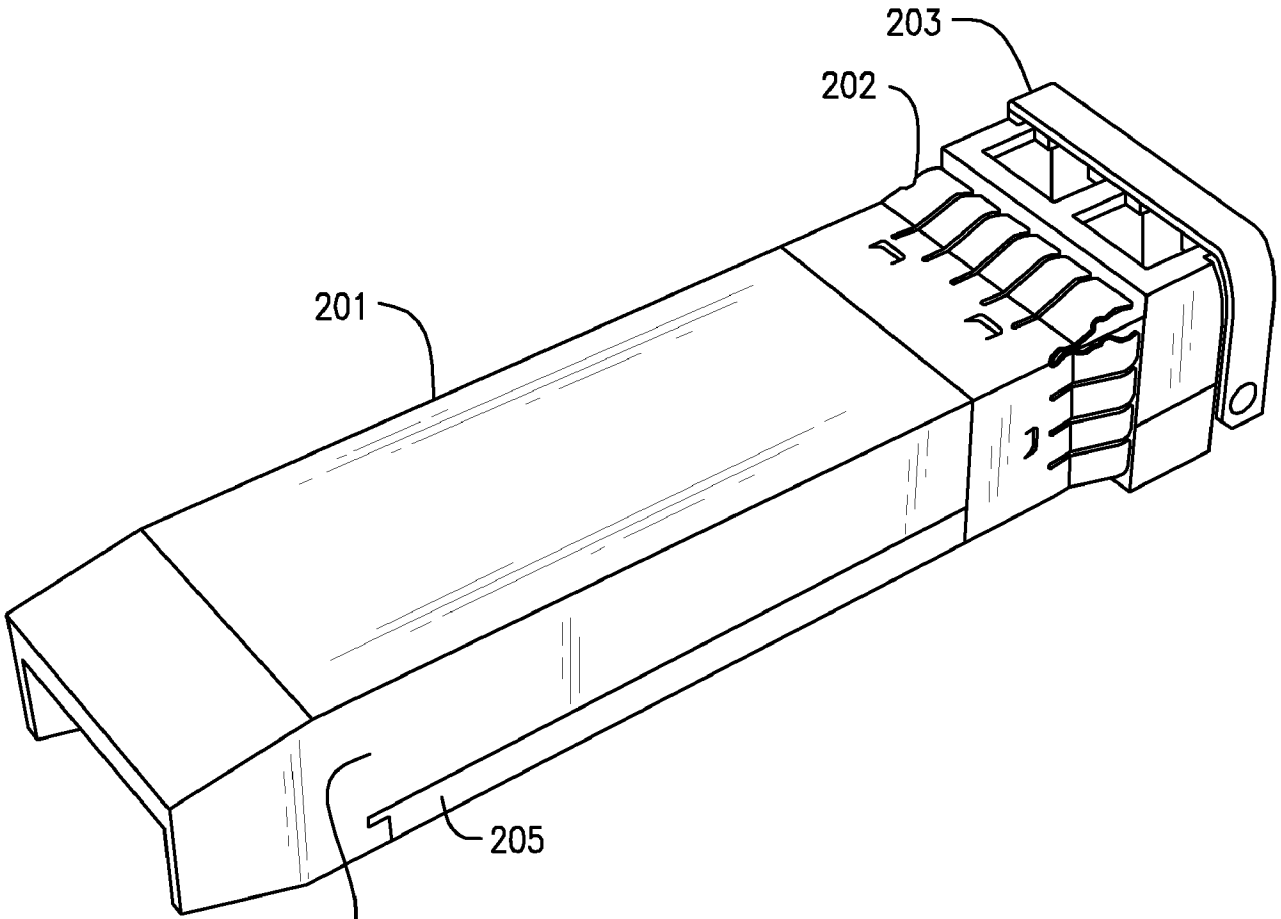
FIG. 2 depicts a prospected view of an exemplary embodiment of an SFP module in accordance with the present invention.
Figure 3:
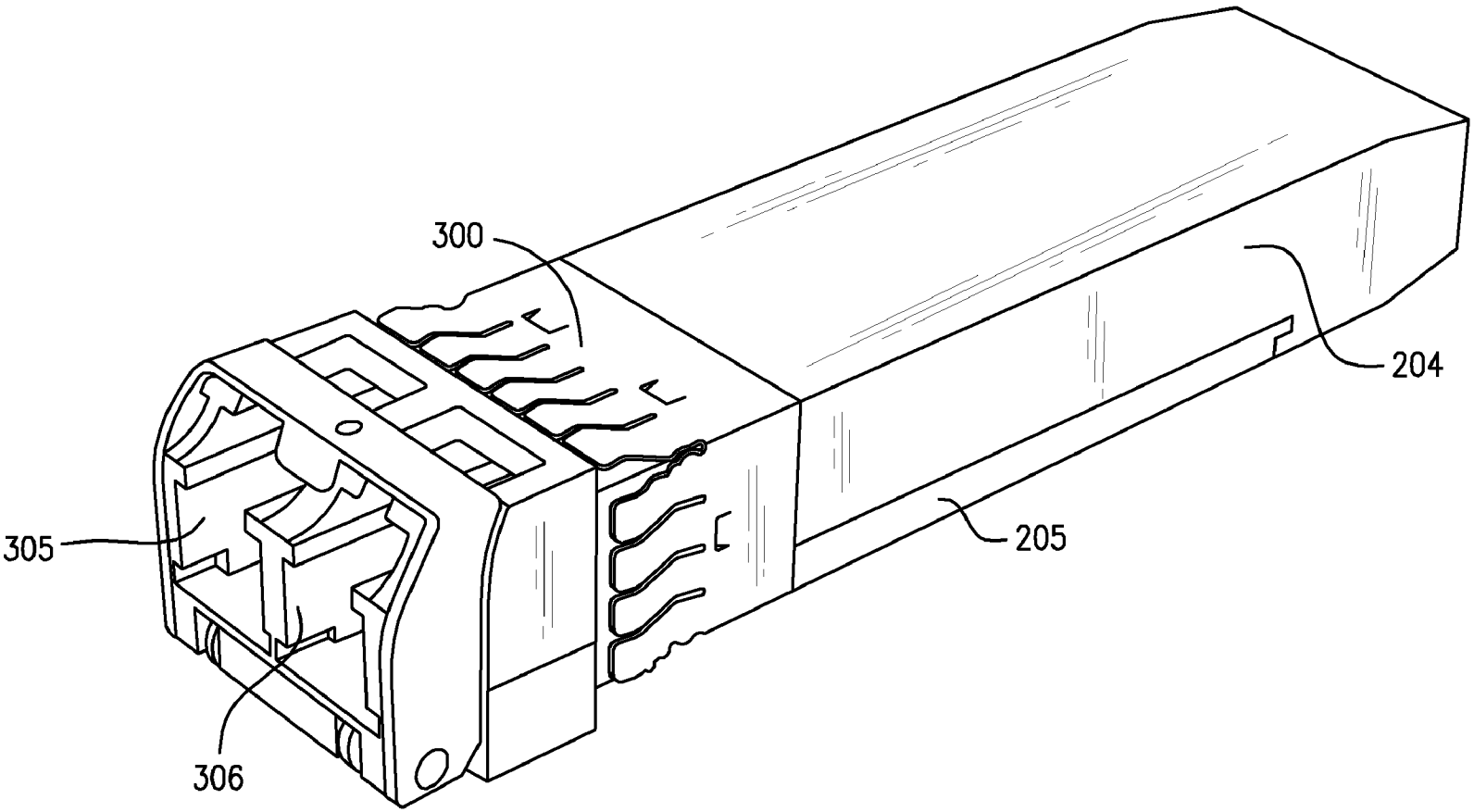
FIG. 3 depicts another view of the SFP module of FIG. 2.
Figure 7:
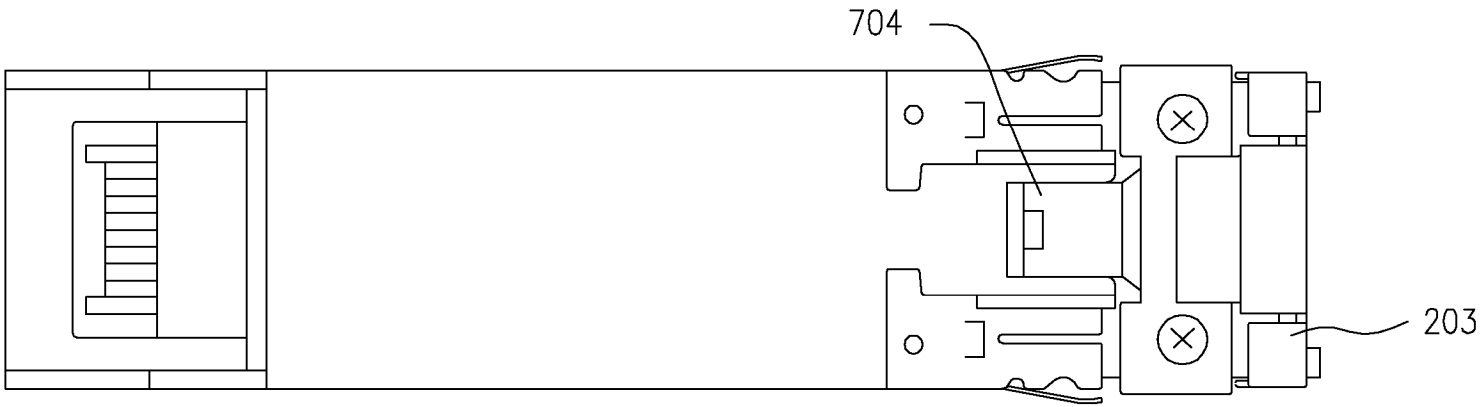
FIG. 7 is a bottom view of an exemplary embodiment of the present invention.
Figure 8:
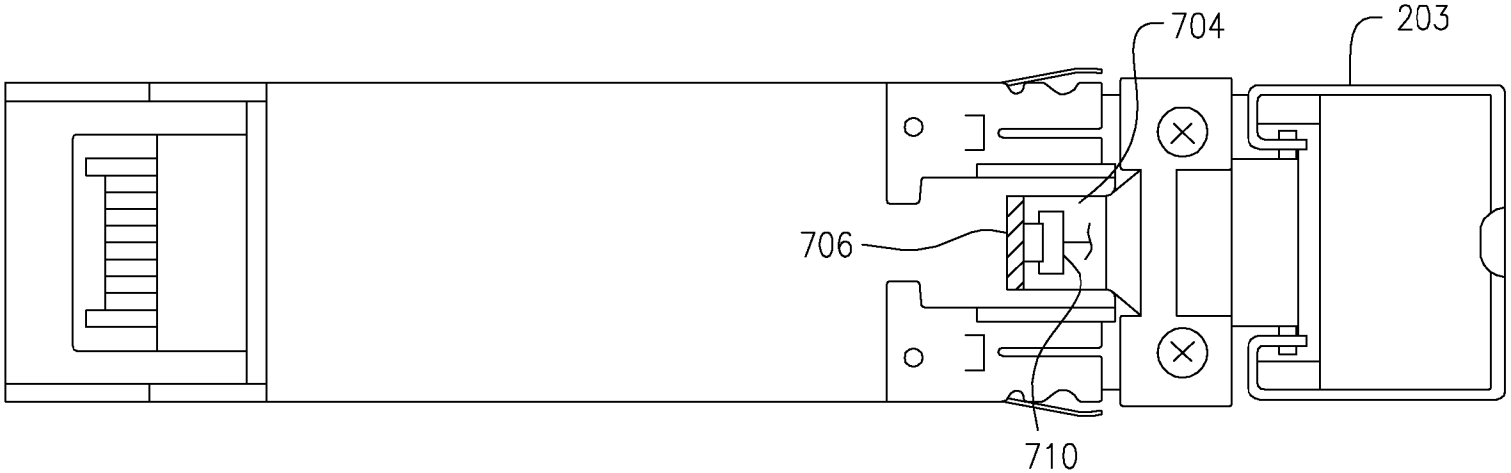
FIG. 8 is an additional bottom view of the arrangement of FIG. 7, with the bail extended.

FIG. 3 depicts a prospective view of an exemplary SFP module of the present invention. The arrangement of FIG. 2 includes a first and second portions 204 and 205 which are placed together to form the module. Fingers 202 are shown extending outwardly from the surface of the module 201. A bail 203 controls a latch as shown in FIGS. 7 and 8, in a manner such that lifting the bail slides the latch out of a opening and permits removal of the module from the chassis. Various such arrangements for using a bail to slide a latch are known.

FIG. 3 depicts a different perspective view of the exemplary of the embodiment of FIG. 2. As shown in FIG. 3, ports 305 and 306 exist for receiving and transmitting optical fibers respectfully.

Figure 1:
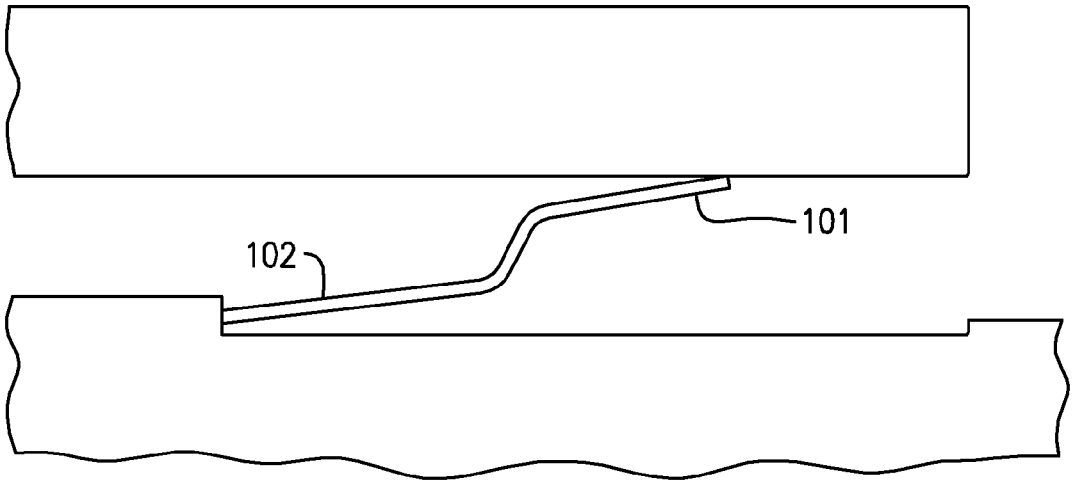
(Prior Art) FIG. 1
FIG. 1 depicts an exploded view of a prior art "finger" installed on the outer surface of an SFP module.
Figure 1A:
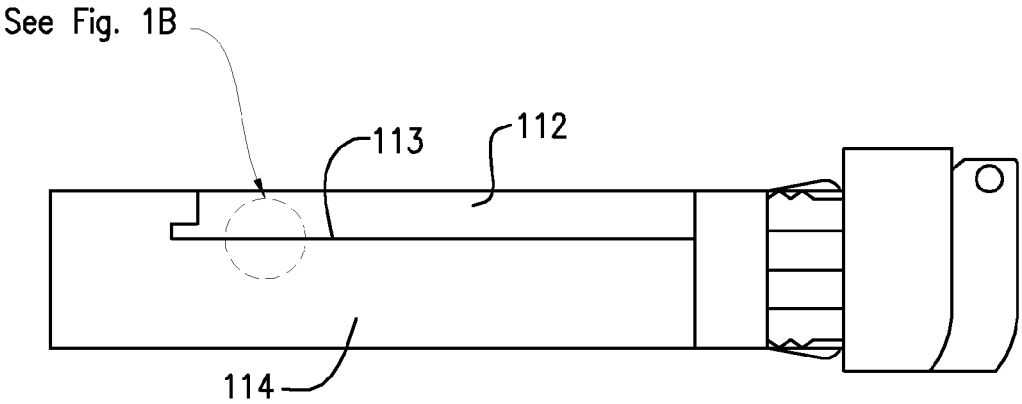
FIG. 1A depicts an assembled prior art SFP module.
Figure 1B:
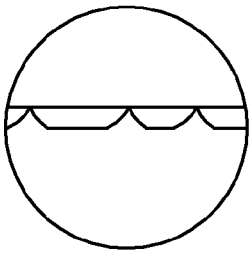
FIG. 1B shows an exploded view of a portion of FIG. 1A, showing leakage at the seam of the two connected portions.
Figure 4:
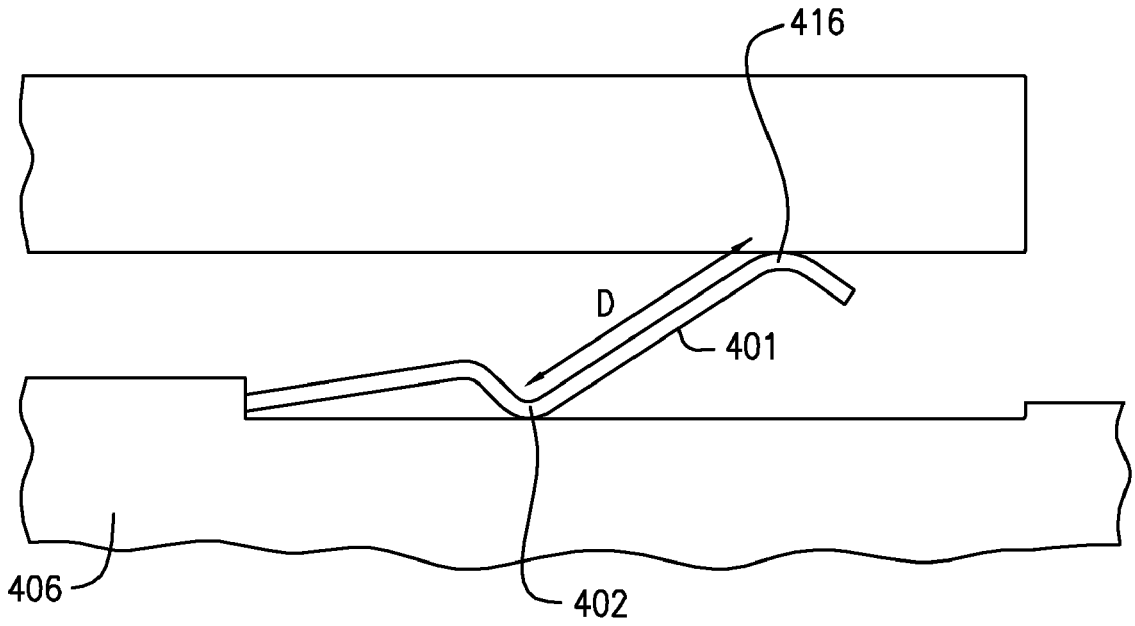
FIG. 4 shows an exploded view of one of the fingers made in accordance with the present invention, when the SFP module is installed in a chassis.

Turning to FIG. 4, shown therein is an exploded view of a finger 401 representing one of the plurality of fingers 300 shown in FIG. 3. As shown in FIG. 4, a slight elbow 402 is placed along the length of FIG. 401 at a point where it is desirable to contact an outside surface of the module 406. Two preferably elbow shaped deformities 402 and 410 are formed in the finger 401. The deformities are formed at prescribed locations along the finger 401 so that the distance indicated as D can be controlled. More specifically, comparing the arrangements of FIGS. 1 and 4, it can be appreciated that the contact points for the fingers are certain and predictable in FIG. 4, rather than varying in a somewhat unpredictable as in FIG. 1. Moreover, by adjusting the distance D appropriately, it can be made shorter than the shortest wavelength of interest, thereby substantially eliminating EMI at the wavelengths of interest.

Figure 5:
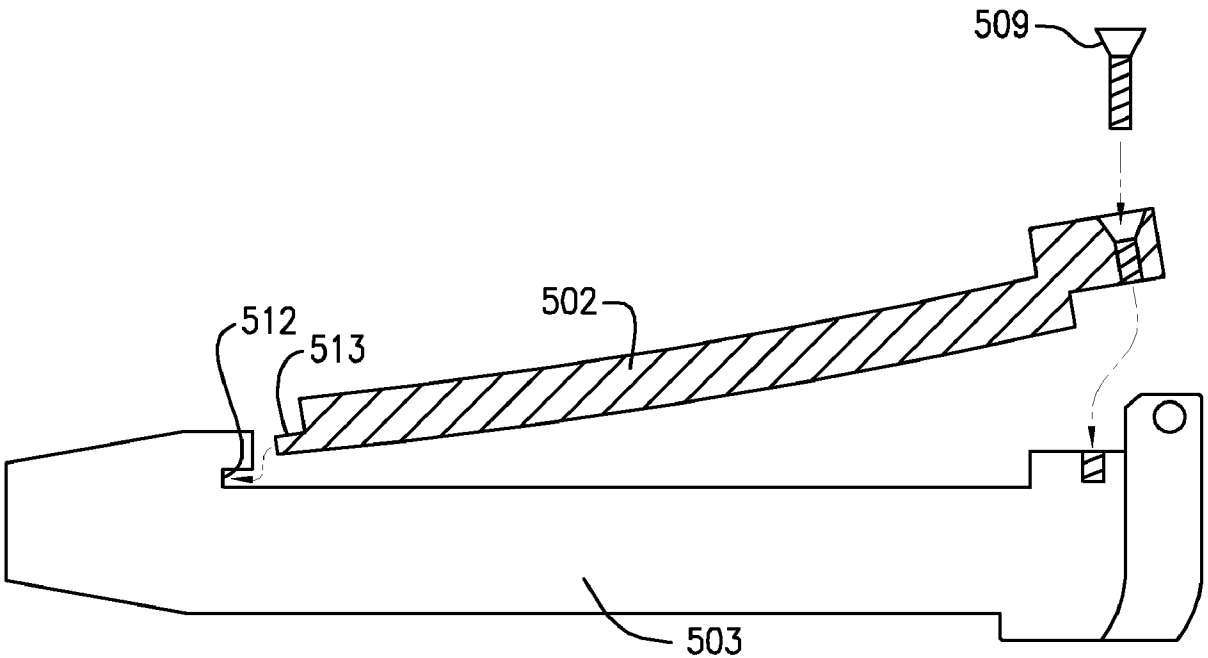
FIG. 5 depicts a nearly assembled view of two portions of the SFP module in accordance with the present invention.
Figure 6:
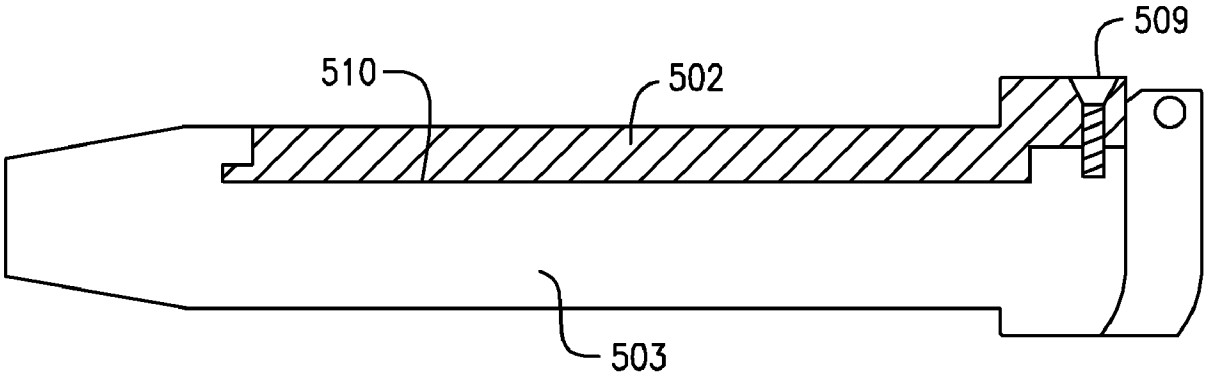
FIG. 6 depicts an assembled view of the SFP module of FIG. 5 in accordance with the present invention.

FIGS. 5 and 6 depict the two portions of the SFP module 502 and 503 that may be brought together to form the completed module. As indicated pictorially, the surface of one or both portions 502 and/or 503 may be curved. Such slight curvature causes a force to be exerted at the seam 510 when the far ends of the two portions are squeezed together and held that way with screw 509 or similar means. As a result, there is a strong pressure forcing the seam closed, assisting to seal it against EMI leakage.

The force pushing the seam together may arise by curving either or both portions. Moreover, by orienting the tab 513 and lip 512 slightly downwardly, rather than completely horizontally as shown, a prying force can be obtained which results in similar pressure being placed at the seam. However, the curved embodiment is more preferred and believed to result in a tighter seal.

FIGS. 7 and 8 depict two views from underneath the module, showing the module in the locked and unlocked position, respectively. As is well known in the art, when the SFPs are plugged into a chassis, the movement of bail 203 from the position of FIG. 8 to that of FIG. 7 locks the SFP in, typically by moving a latch or similar protrusion into an opening or the like. Many variations on this basic idea exist in the market.

The area 704 represents an opening in which a latch or suitable structure typically slides or otherwise moves. Because the latch must be able to engage some portion of the chassis into which the SFP module is installed, there is an opening through which EMI leakage may occur.

To minimize leakage here, an EMI gasket materials used to create a seal around the latch. The EMI seal is realized as a compressive/compliant conductive foam gasket or as a metallic spring finger. The positive electrical contact between the sliding latch mechanism and the optical transceiver provided by the conductive foam or metallic spring finger results in an effective EMI seal. The EMI material is preferably placed underneath any slidable, moving mechanism, such as a latch, and assists in further sealing the opening to EMI leakage.

FIG. 8 shows EMI gasket 706 according to one embodiment of the invention. Latch assembly 710 is exposed in an opening 704 (FIGS. 9-10) of the chassis of the module 201. Gasket 706 is shown at the bottom of opening 704 (when viewing module 201 of FIG. 8 such that bail 203 is at the top).

Figure 9:
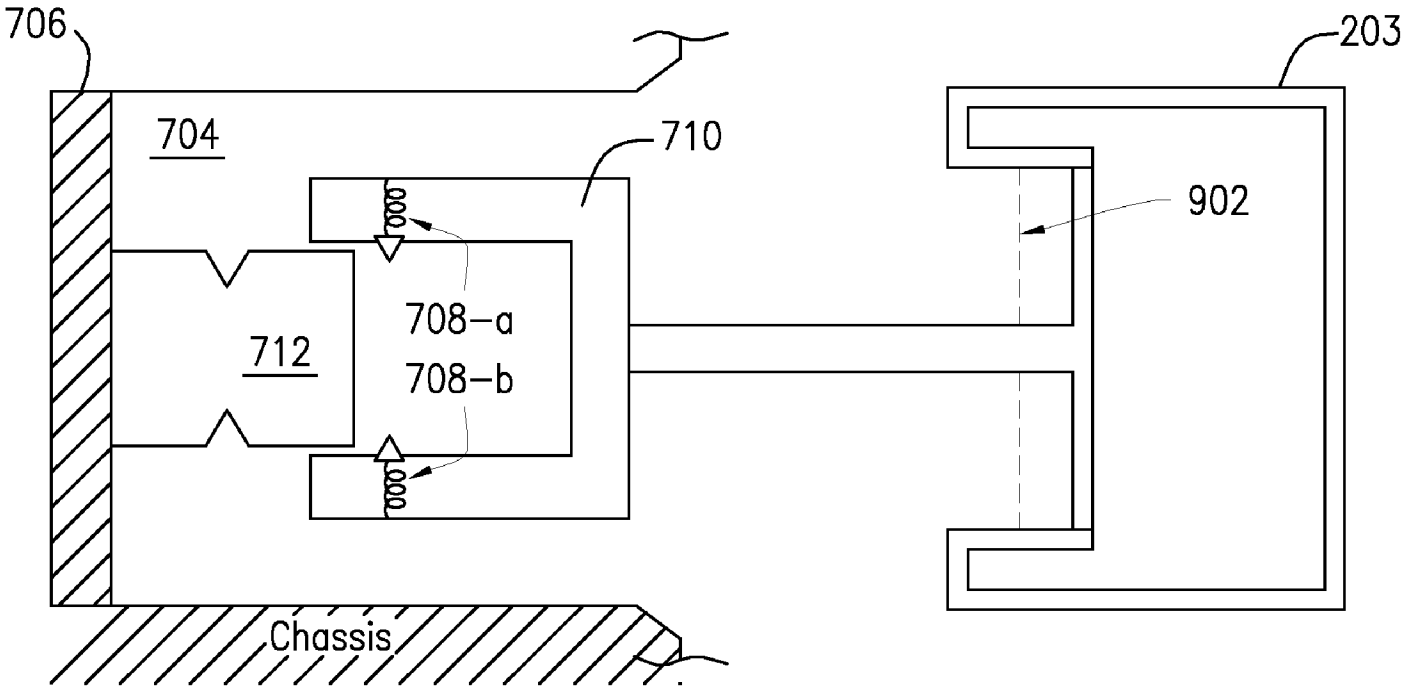
FIG. 9 is a top view of the module with the bail in an unlocked position with a latch assembly and a latch located in an opening in the chassis of the module.

FIG. 9 shows latch assembly 710 which includes latch 708 (which in turn includes latch portions 708-*a* and 708-*b*) exposed through opening 704 in the rightmost surface of the chassis and movable in response to rotation of bail 203 about pivot axis 902. FIG. 9 shows latch assembly 710 and latch 708 in an unlocked position. Gasket 706 is located within opening 704 and underneath latch 708 (gasket 706 is "underneath" latch 708 when viewing module 201 such that bail 203 is on top) and aids in maintaining an EMI seal. FIG. 9 shows latch 708 proximate to chassis block 712, but not yet engaged therewith.

Figure 10:
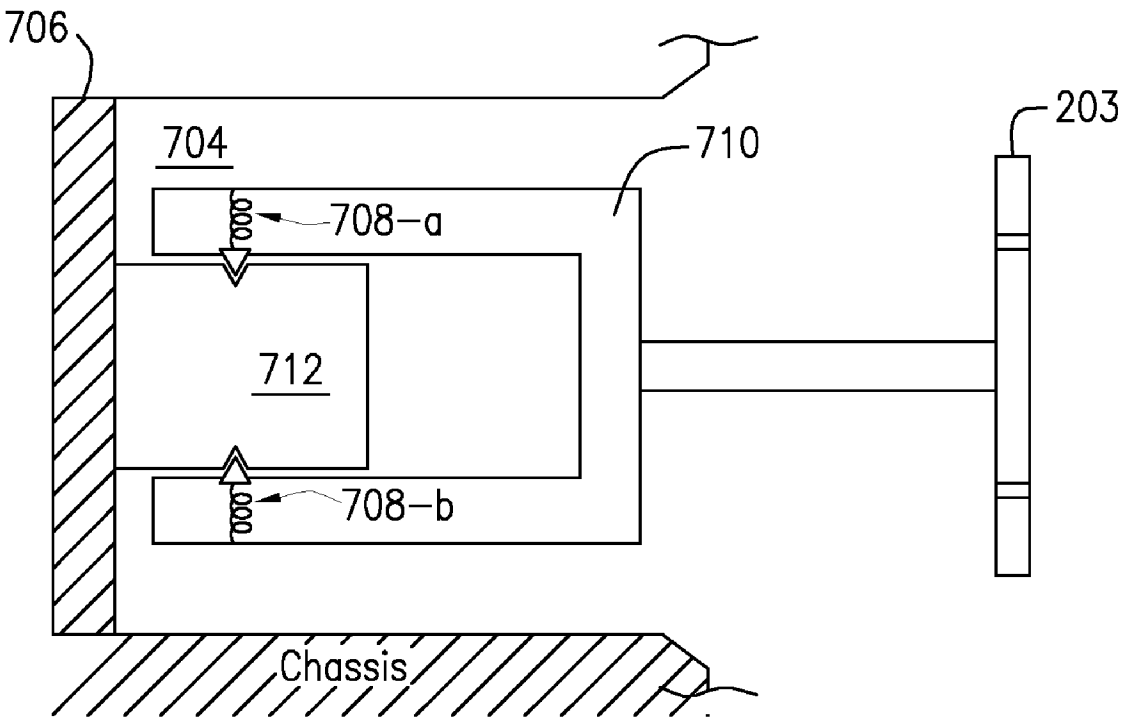
FIG. 10 is a top of view of the module with the bail and the latch of FIG. 9 in locked positions.

FIG. 10 shows the apparatus of FIG. 9 with latch 708 locked onto chassis block 712. Bail 203 has been rotated clockwise ("clockwise" when viewing bail 203 from below in the view of FIG. 9) about pivot axis 902 from the position of bail 203 shown in FIG. 9, thereby advancing latch assembly 710 and latch 708 leftward in the view of FIGS. 9 and 10, thereby enabling latch portions 708-*a* and 708-*b* of latch 708 to engage respective grooves in the chassis block 712 within opening 704 in the chassis.

The combination of the fingers with the deformities, one or more curved sections of the module, and additional of the EMI gasket results in the sealing of the SFP module to EMI to a greater degree than was previously thought possible, particularly at higher data rates (e.g.; above 10 GB/s). Any one of more of the foregoing may be used alone or in combination to assist in the diminishing EMI from interfering with the operation of the device. While the foregoing describes the preferred embodiment of the invention, various modifications and/or additions will be apparent to those of skill in the art.

The invention claimed is:

1. An optical/electrical module having a surface and a bail and a latch, the latch being exposed through an opening in the surface and movable in response to movement of the bail, the module further including an EMI gasket installed within said opening and underneath said latch so that an EMI seal is maintained.

2. The optical/electrical module of claim 1 wherein the surface is closed by connecting two longitudinal sections, at least one of which has a curved deformity.

3. The optical/electrical module of claim 2 further comprising a plurality of fingers extending upwardly and outwardly from said surface, said plurality of fingers each including at least two elbow shaped deformities.

4. The optical/electrical module of claim 3 wherein the fingers are present on at least three of four sides of said surface.

5. The optical/electrical module of claim 1 wherein one of the two longitudinal sections has a ledge, and a second of said sections has an indent into which said ledge fits.

6. A method of assembling an optical/electrical module having at least two elongated portions, at least one of said portions having a curved profile along a longitudinal directions thereof, the method comprising bending the curved profile into a non-curved profile to meet with the other of said elongated portions, and affixing the two elongated portions together.

7. The method of claim 6 wherein said bending further comprises the steps of placing a ledge at one end of said elongated portions under an indent at on another of said elongated portions and then forcing the two elongated portions together against the curvature of at least one of the elongated portions.

* * * * *